US005211109A

United States Patent [19]

Determan

[11] Patent Number: 5,211,109

[45] Date of Patent: May 18, 1993

[54] BEVERAGE CAN CRUSHER

[76] Inventor: Jerome A. Determan, 219 Sylvan Dr., Fairmont, Minn. 56031

[21] Appl. No.: 767,119

[22] Filed: Sep. 27, 1991

[51] Int. Cl.[5] ..... B30B 9/32; B30B 3/04

[52] U.S. Cl. ..... 100/98 R; 100/172; 100/173; 100/176; 100/902; 241/99

[58] Field of Search ..... 241/99; 100/98 R, 155 R, 100/172, 173, 176, 902

[56] References Cited

U.S. PATENT DOCUMENTS

| | | | |
|---|---|---|---|
| 8,302 | 6/1878 | Loring | 100/176 |
| 2,619,150 | 11/1952 | Smith . | |
| 3,066,600 | 12/1962 | Couty | 100/902 |
| 3,504,621 | 4/1970 | Qualheim | 241/99 |
| 3,687,062 | 8/1972 | Frank . | |
| 3,749,004 | 7/1973 | Pagdin | 100/902 |
| 3,814,009 | 6/1974 | Davis, Jr. et al. . | |
| 4,369,699 | 1/1983 | Dailey | 100/902 |
| 4,445,430 | 5/1984 | Pyne . | |
| 4,573,641 | 3/1986 | DeWoolfson et al. . | |
| 4,862,796 | 10/1989 | Lodovico | 100/902 |
| 4,919,274 | 4/1990 | Hammond . | |
| 4,925,117 | 5/1990 | Ramos . | |
| 4,989,507 | 2/1991 | Rhoades et al. . | |
| 5,025,995 | 6/1991 | Smith | 100/902 |

FOREIGN PATENT DOCUMENTS

| | | | |
|---|---|---|---|
| 3504248 | 8/1986 | Fed. Rep. of Germany | 100/902 |
| 601469 | 1/1960 | Italy | 100/902 |
| 0397158 | 11/1990 | Italy | 100/902 |
| 59-50997 | 3/1984 | Japan . | |
| 0286296 | 11/1988 | Japan | 100/902 |
| 2129726 | 5/1984 | United Kingdom | 100/902 |

*Primary Examiner*—Philip R. Coe
*Assistant Examiner*—Randall E. Chin
*Attorney, Agent, or Firm*—Merchant, Gould, Smith, Edell, Welter & Schmidt

[57] ABSTRACT

A beverage can crusher has a pair of rollers which rotate toward one another to crush a can between them. The crusher has a deposit window and chute which place the cans above the rollers and ensure that the cans are flattened from the sides rather than smashed from the top. This provides for a repeatable, baleable crushed can. An actuator placed less than one can length above the rollers in the chute energizes the drive motor to rotate the rollers and continues to have the rollers rotating as long as there is a can engaging the actuator The rollers have a special receiving surface and engaging surfaces which grip the sides of the can to minimize slipping so that the can will be pulled down between the rollers. In addition, pins extend radially outward from the outer surface of the rollers to further grip the can.

12 Claims, 6 Drawing Sheets

BEVERAGE CAN CRUSHER

BACKGROUND OF THE INVENTION

1. Field of the Invention

The present invention relates to an apparatus for crushing cans for recycling.

2. Description of the Prior Art

Recycling of cans, and in particular beverage cans, has increased rapidly over recent years as garbage disposal has become a greater problem and recycling has become economically feasible. Since beverage cans occupy a relatively large volume with relatively little weight, handling of cans can be eased by compacting the cans. To further increase ease of handling and to aid in automated handling of cans for recycling, it is advantageous to crush each can into substantially the same shape. So that the crushed cans may be baled, the cans should be crushed so that they are flattened from the sides rather than smashed downward from the top to obtain a flatter can. It has been found that cans crushed from the top have more of a ball-type shape and are more difficult to handle by automated machinery than side-flattened cans.

As the need for crushed cans has increased, devices for crushing the cans have been developed. Prior art beverage crushers as represented by U.S. Pat. No. 4,925,117 to Ramos, utilizes a pair of rollers to crush cans. The rollers in the Ramos patent have crushing teeth and pins to puncture cans to let any remaining liquids escape from the can for reducing pressure prior to crushing. However, the rollers of the Ramos patent do not achieve a repeatable crushed can shape with each can. The teeth of the rollers are not opposed and are intermeshing so that the shape of the final crushed can will vary from can to can.

It can be seen then that a can crusher is needed which crushes cans in a repeatable flattened shape and which leaves the crushed can intact for recycling. It can also be seen that a crushing device is needed which is tripped by cans being fed to the crusher rollers and which rotates the rollers until all cans which are fed into the crusher are crushed.

SUMMARY OF THE INVENTION

The present invention is directed to a can crusher for crushing empty cans, and especially for crushing beverage cans to ease handling for recycling. According to the present invention, a can crusher utilizes a depository window and attached chute which leads to a pair of rollers for pinching empty cans between them and flattening out the cans into an easy, flat, baleable final form. When cans reach the bottom of the delivery chute, an actuator of a switch is tripped by the can in the lower portion of the chute which activates a motor to rotate a pair of rollers. The can has its bottom resting on the upper portion between the rollers so that as the rollers rotate toward one another, upon catching the can, the can will be pulled down between the rollers and crushed.

The shape of the rollers is important for gripping the can to insure that the can is pulled down between the rollers rather than repeatedly bouncing off the tops of the rotating rollers. To facilitate gripping, the rollers have surfaces which receive the bottom of the can so that the bottom of the can rests against these flat surfaces. A hardened engaging surface extending radially outward from the center of each roller forms a corner with the periphery of the radial surface of the roller. The engaging surfaces grip the sides of the can and pull the can down between the rollers. Should the can not catch on the first engaging surface, the can will remain essentially in place while the rollers rotate so that when the rollers rotate 180 degrees, receiving surfaces will position the can and another pair of engaging surfaces will grip the can and pull it between the rollers. To ensure that no slipping occurs as the can is being crushed, pins extending radially outward from the radial surface of the rollers are spaced apart and complementary on the opposing rollers for gripping the can. The pins engage the sides of the can to prevent any slippage as the can is being pinched between the rollers.

It can be appreciated that according to the present invention, the rollers will continue to rotate if more than one can is in the chute and the switch is actuated. It can also be appreciated that the present invention provides for crushing a can into a flat baleable form which leaves the can intact for possible redemption.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

In the drawings, wherein like reference numerals and letters indicate corresponding elements throughout the several views.

DETAILED DESCRIPTION OF THE PREFERRED EMBODIMENT(S)

Figure 1:
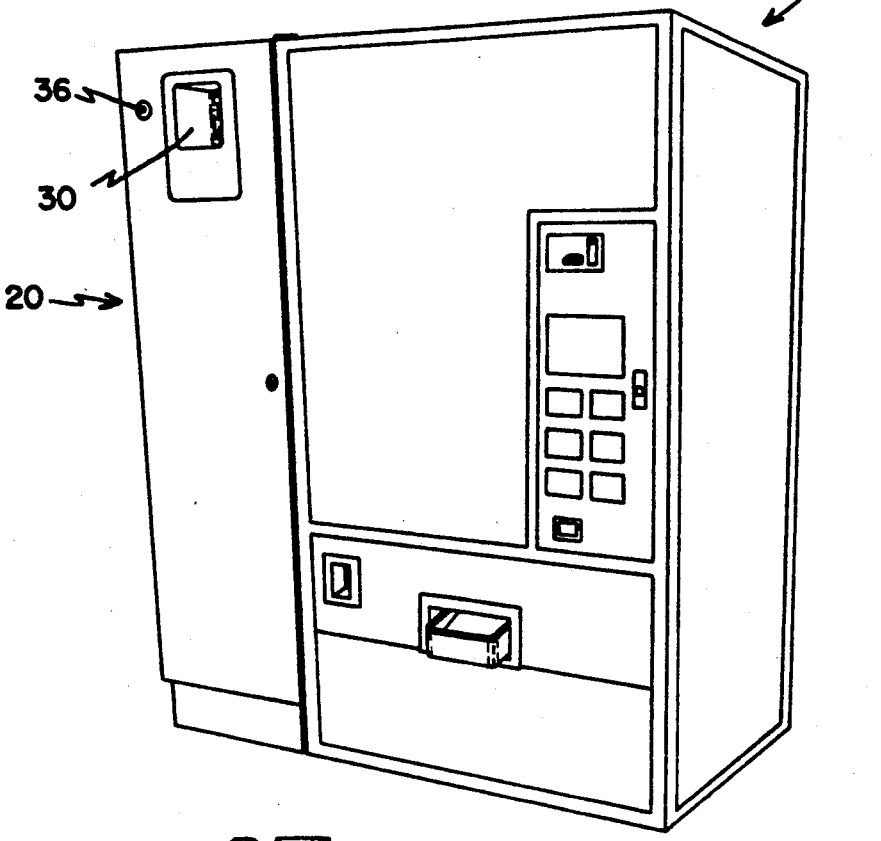
FIG. 1 shows a perspective view of a vending machine and a can crusher according to the principles of the present invention.

Referring now to the drawings, and in particular to FIG. 1, there is shown a beverage vending machine 22 next to an automatic can crusher 20. The beverage can crusher 20 may be placed proximate the vending machine 22 so that cans may be conveniently deposited into the machine after the beverage has been consumed. On its front panel, the crusher 20 utilizes a depository window 30 for receiving cans to be crushed and has a warning light 36 which indicates that a foreign object has entered the crusher which cannot be crushed by the crusher, thereby tripping a circuit breaker.

Figure 2:
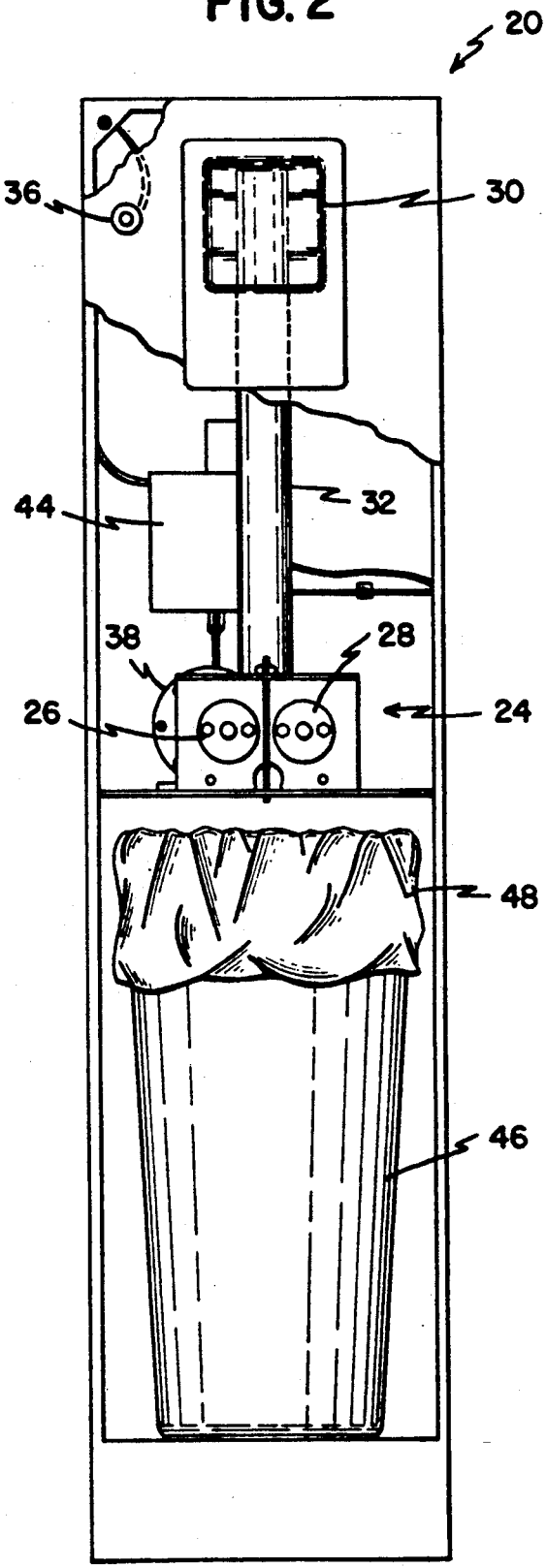
FIG. 2 shows a front elevational view of the can crusher shown in FIG. 1 with a portion of the crusher shown in section.

Referring now to FIG. 2, the crusher 20 utilizes a crushing mechanism 24 to crush cans which then drop into a waste receptacle 46 which may have a removable bag 48 to collect the crushed cans. The depository window 30 has a vertical chute 32 which drops to a pair of rollers 26 and 28. The rollers 26 and 28 are powered by an electric motor 38.

Figure 3:
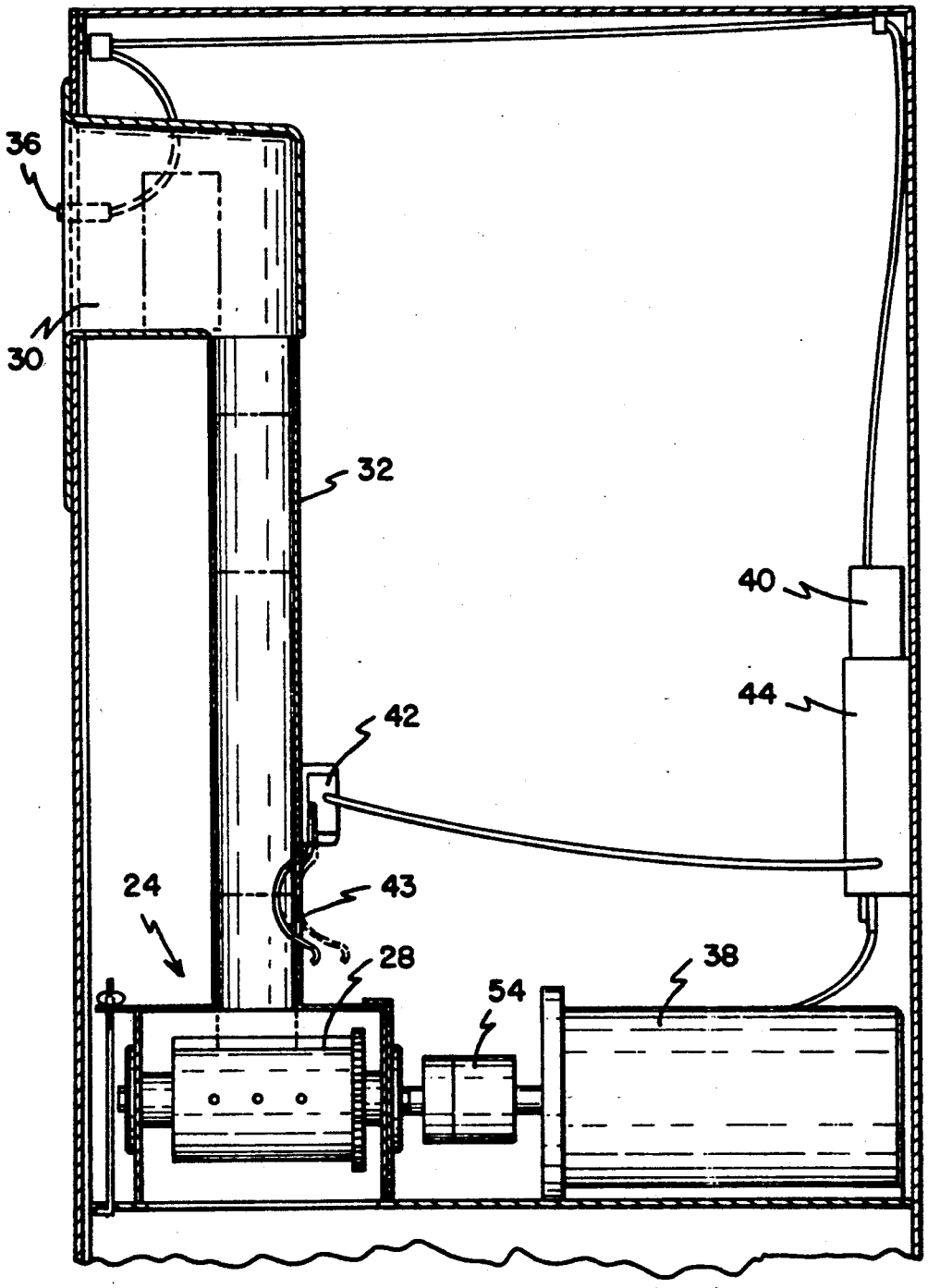
FIG. 3 shows a side sectional view of a portion of the can crusher shown in FIG. 1.
Figure 5:
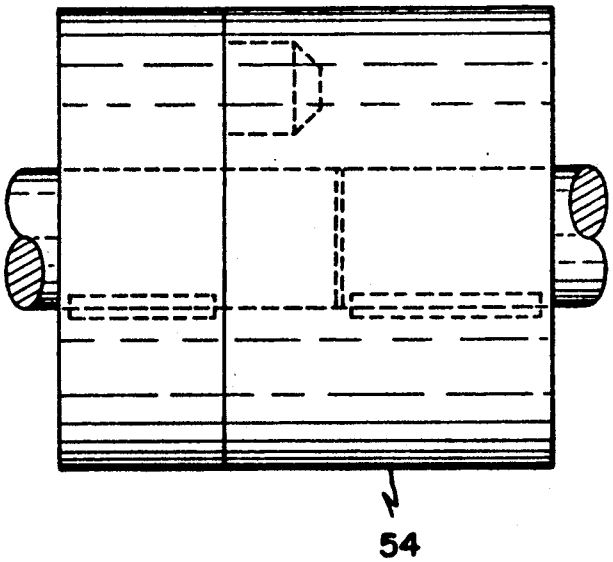
FIG. 5 shows a portion of the coupling for the can crusher shown in FIG. 1.

As shown in FIG. 3, the motor 38 connects to a first roller 26 (hidden by roller 28 in FIG. 3) by a coupling 54. In the preferred embodiment, the motor draws 4.7 amps and has a 5.0 amp manually reset circuit breaker in a control box 44. With this arrangement, should a foreign object which cannot be crushed engage the rollers 26 and 28, the circuit breaker will trip so that the motor 38 will not burn out. The rollers 26 and 28 are rotated by the coupling 54, also shown in FIG. 5, which drives roller 26. Roller 28 is then driven through gears 56 which engage between the two rollers. The rollers 26 and 28 are mounted in a housing 52 which supports nylon bearings 68 engaging shafts 66 of the rollers.

Figure 6:
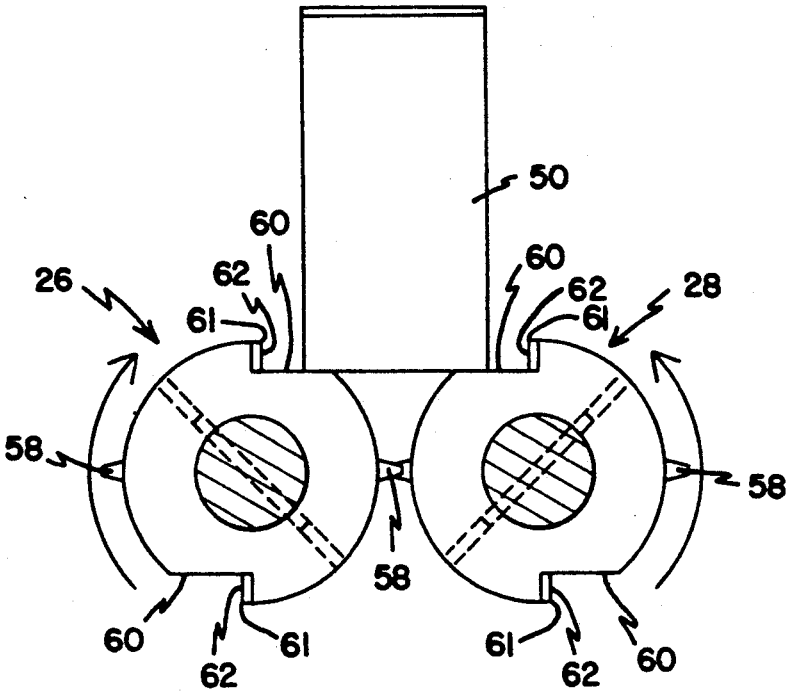
FIG. 6 shows an end view of the rollers shown in FIG. 4 with a can placed on the rollers prior to crushing.

The rollers 26 and 28 have radially extending pins 58 mounted on their outer radial surface which engage cans when the rollers are rotating. As shown in FIGS. 6–9, each roller has a pair of diametrically opposed flattened portions 60. Each roller also has a pair of diametrically opposed engaging surfaces 62, preferably formed from a hardened alloy. The engaging surfaces 62 extend radially outward from the central axis of each roller and face the surface on the other roller, as shown in FIG. 6. As the flattened portions 60 rotate to an upper position, they accept the bottom of the can 50 and hold it in position so that the sides of the can 50 will be gripped by the engaging surfaces 62. Sharp corner edges 61 formed by the engaging surfaces 62 of each roller and the periphery of each roller rotates to grip the can, as explained hereinafter.

Referring again to FIG. 3, a switch actuator 43 in the chute 32 operates a switch 42 with a time delay relay 40 to actuate the crushing mechanism 24. The switch 42 has a specially formed actuator 43 extending into the chute which is pushed in when a can 50 is in the lowermost portion of chute 32. Thus, operating the time delay relay 40 and actuating the crusher motor 38 to rotate the rollers 26 and 28. As long as a can 50 remains in the lower portion of the chute 32, the rollers 26 and 28 will continue to rotate. The switch 42 is placed so that when a can rests on the rollers 26 and 28, the switch continues to be engaged, so that the rollers will rotate. When the can 50 has been pulled down and is being crushed between the rollers 26 and 28, the actuator 43 of the switch 42 will move back into the chute 32 and after delay of sufficient time to crush the can, will deactivate the control circuit. It can be appreciated that if several cans are stacked one on top of another in chute 32, the switch actuator 43 will be pressed in and the rollers 26 and 28 will continue to rotate until the chute 32 becomes clear.

Figure 4:
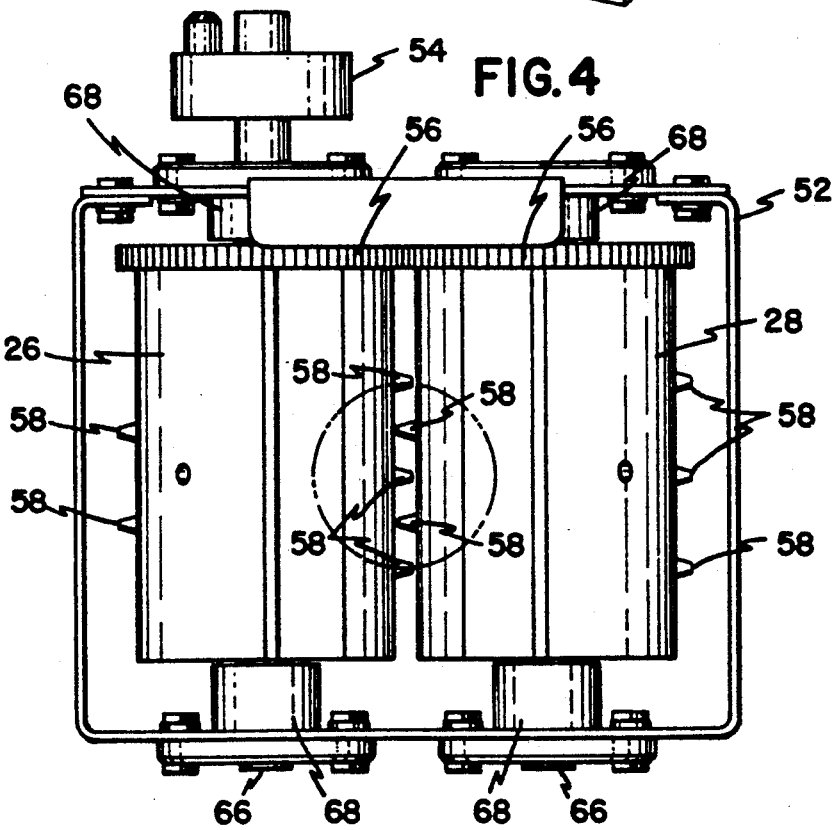
FIG. 4 shows a top view of the crusher rollers for the can crusher shown in FIG. 1.
Figure 7:
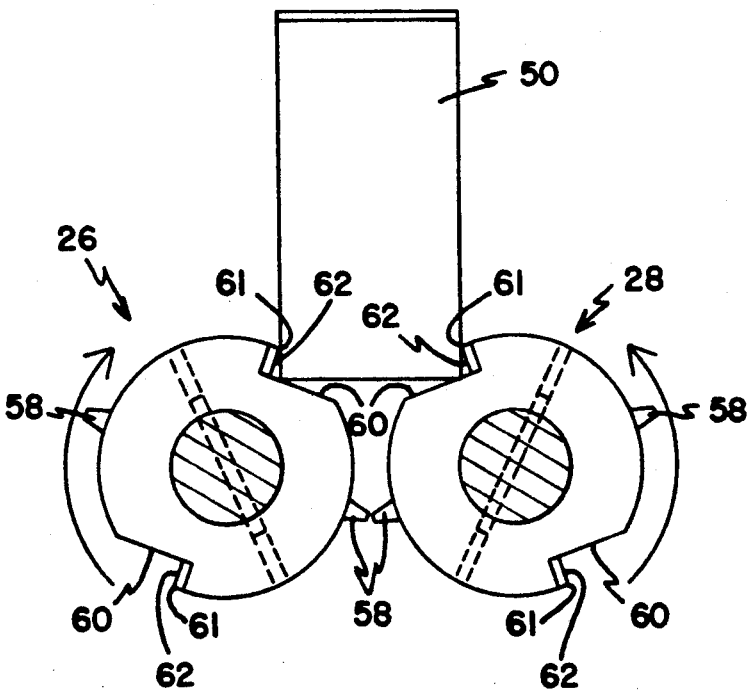
FIG. 7 shows an end view of the rollers shown in FIG. 6 with the can gripped before it is crushed.
Figure 8:
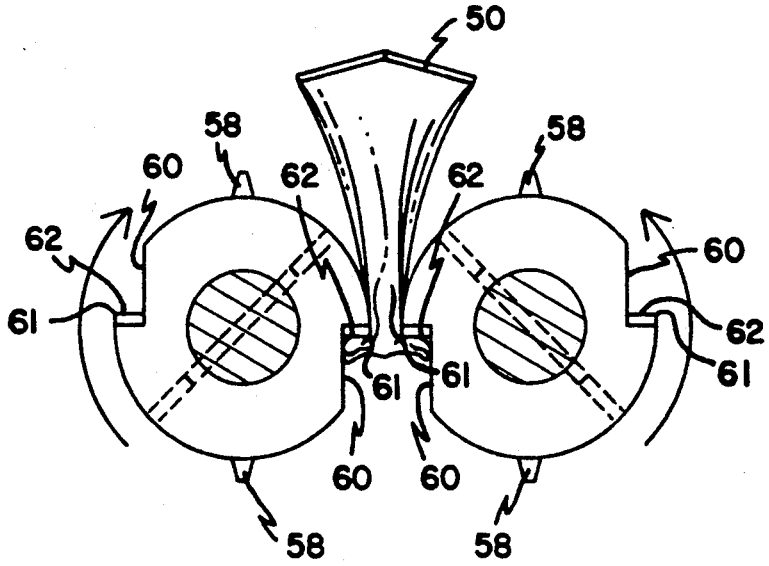
FIG. 8 shows an end view of the rollers shown in FIG. 6 with the rollers rotated so that the can is partially crushed.
Figure 9:
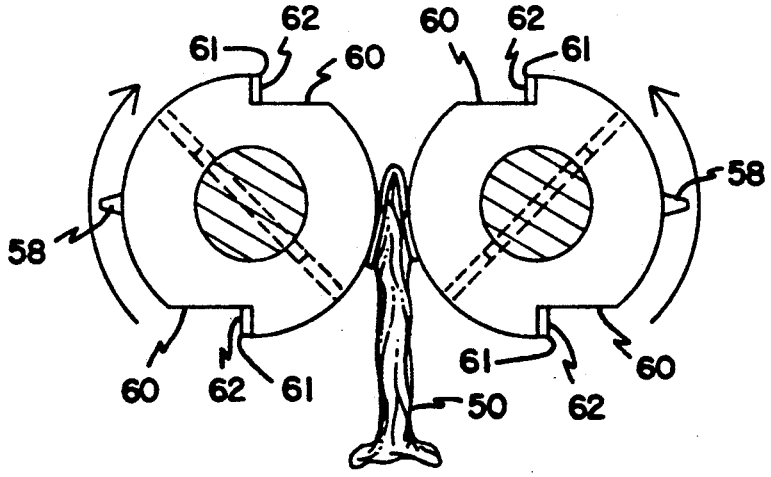
FIG. 9 shows an end view of the rollers shown in FIG. 6 with the rollers rotated so that can is fully crushed.

Referring again to FIGS. 6–9, when a can 50 drops onto the rollers 26 and 28, the can 50 will be engaging the actuator 43 of the switch 42, so that the rollers 26 and 28 will begin rotating toward one another, as indicated by directional arrows. If the sharp corner edges 61 of the engaging surfaces 62 do not catch the sides of the can 50, the switch actuator 43 will continue to be pushed in so that the rollers 26 and 28 will continue to rotate. However, when the engaging surfaces do grab the can 50, as shown in FIG. 7, the widened outer surfaces of the rollers 26 and 28 will pinch the can 50 as shown in FIG. 8. At this point, the outer surfaces of the rollers are pinching the can 50 and crushing it between them so that the can obtains a flattened profile similar to that shown in FIG. 10. The pins 58 grab the can 50 as shown in FIG. 9 to prevent the can from slipping against the outer surface of the rollers 26 and 28. It can be appreciated that with most cans, the rollers 26 and 28 need to rotate only 180 degrees to fully crush the can. As can be seen in FIG. 4, the pins 58 are complementary so that they are spaced apart across the width of a can to insure a good grip across the can and ensure that the rollers will not jam from the pins 58 contacting one another.

Figure 10:
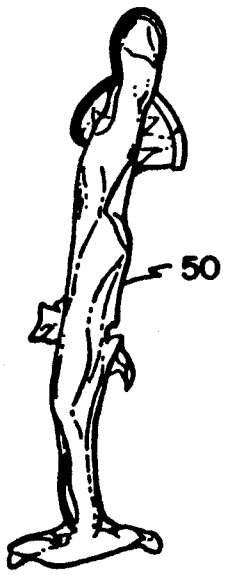
FIG. 10 shows a side view of a can crushed with the apparatus of the present invention; and, FIG. 11 shows a top view of the crushed can of FIG. 10.
Figure 11:
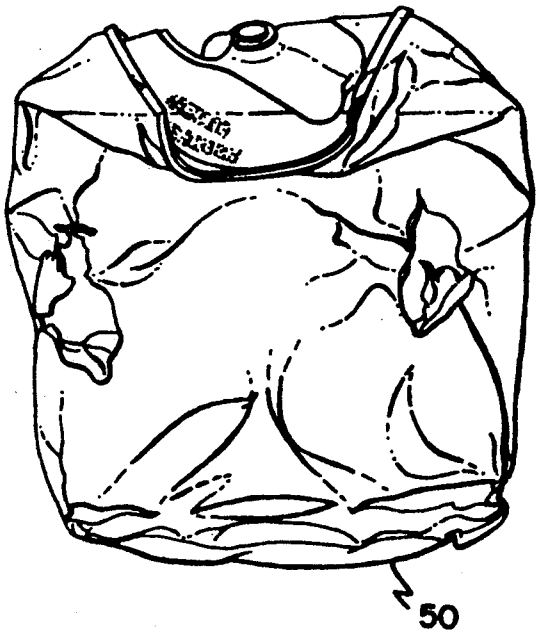

As shown in FIGS. 10 and 11, it can be seen that the can 50, when fully crushed, has a relatively narrow profile and is flattened so that the cans can be easily baled. In addition, the shape of the can 50 is compacted substantially from its original size so that storage and handling of the cans requires much less volume. It can also be appreciated that the can 50 is intact so that it can be redeemed in States which require the can to be intact for redemption and also provides for easily counting the cans. In addition, the rollers provide for a substantially repeatable final shape of each crushed can, further aiding in design of handling machines.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A beverage can crusher, comprising:

(a) a frame;

(b) a pair of spaced, generally cylindrical rollers rotatably mounted in said frame on parallel horizontal shafts;

(c) each said roller having a pair of oppositely disposed axially extending can engaging surfaces lying in a plane extending through a longitudinal axis of each roller, wherein a first can engaging surface on each roller comprises a first set of can engaging surfaces and a second can engaging surface on each roller comprises a second set of can engaging surfaces, said rollers being disposed on said shafts so that said first set of said can engaging surfaces face each other in a first can accepting position at the top of the rollers once per revolution and said second set thereof face each other at said can accepting position when said first set is disposed at the bottom of said rollers;

(d) each of said rollers having a pair of oppositely disposed flat surfaces extending perpendicular to corresponding ones of said can engaging surfaces, wherein a first flat surface on each roller comprises a set of flat surfaces and a second flat surface on each roller comprises a set of flat surfaces, so that in said can accepting positions one set of said flat surfaces are co-planar to support and accept a beverage can placed thereon, each of said rollers having can crushing surfaces between said other surfaces;

(e) means for rotating said rollers in opposite directions to draw the can down between said rollers with said can engaging surfaces engaging and compressing the sides of the can above its bottom end to assist in pulling the can down between said can crushing surfaces of said rollers; and (f) a plurality of pins extending from said can crushing surfaces of each of said rollers generally midway between said can engaging surfaces to assist in pulling the can down between said rollers wherein said pins of a first said roller are spaced in a complementary intermeshing arrangement with said pins of a second said roller.

2. A can crusher according to claim 1 wherein said can engaging surfaces each have a sharp corner edge to engage the cans.

3. A can crusher according to claim 2 wherein said can engaging surfaces each comprise a strip of hard metal and each said metal strip has a generally rectangular cross sectional configuration with a flat surface thereof facing outwardly and a forwardly facing flat surface forming said sharp corner edge.

4. A can crusher according to claim 3 wherein said outwardly facing flat surfaces and said can crushing surfaces of each roller lie along a surface of said roller having a generally circular cross section.

5. A can crusher according to claim 2 wherein said sharp corner edges and said can crushing surfaces of each roller lie along a circle defined by a cross section of said roller.

6. A can crusher according to claim 1, wherein said pins are spaced such that pins on a first roller intermesh with pins of a second roller while engaging the beverage can.

7. A can crusher according to claim 6, wherein said pins on said first and second rollers intermesh along a plane extending between axes of said pair of rollers.

8. A can crusher according to claim 1, further comprising a delivery chute positioned above said roller pair intermediate said rollers, wherein said chute has a crosssectional dimension smaller than the length of a beverage can, whereby the beverage cans are deposited between said rollers in an upright position.

9. A can crusher according to claim 8, wherein the circumference of said rollers is about twice the length of a beverage can.

10. A beverage can crusher, comprising:

(a) a frame;

(b) a pair of rollers rotatably mounted in said frame on parallel shafts, said rollers being spaced apart a distance less than the dimension of a can to be crushed;

(c) each said roller having a pair of oppositely disposed generally longitudinally extending can engaging surfaces wherein a first can engaging surface on each said roller comprises a first set of can engaging surfaces and a second can engaging surface on each said roller comprises a second set of can engaging surfaces, said rollers being disposed on said shafts so that a first set of said can engaging surfaces face each other in a first can accepting position twice per revolution and a second set thereof face each other at said can accepting position when the first set is oppositely disposed;

(d) each of said rollers having a pair of oppositely disposed surfaces intersecting corresponding ones of said can engaging surfaces, wherein a first oppositely disposed surface on each said roller comprise a set of said surfaces, and a second oppositely disposed surface on each said roller comprise a set of said surfaces so that in said can accepting positions, a set of said surfaces are positioned to support an accept a beverage can placed thereon; each of said rollers having can crushing surfaces between said other surfaces;

(e) means for rotating said rollers in opposite directions to draw the can between said rollers with said can engaging surfaces engaging and compressing the can to assist in pulling the can between said can crushing surfaces of said rollers; and (f) means extending from said can crushing surfaces of said rollers generally mid-way between said can engaging surfaces to assist in moving the can between said rollers wherein said can assist moving means comprise pins, and wherein said pins of each said roller are spaced in a complementary intermeshing arrangement with said pins of the other said roller.

11. A can crusher according to claim 10 wherein said rollers are sized so that said first and second sets of can engaging surfaces are circumferentially spaced a sufficient distance to permit a can to be drawn generally through the rollers by one set before the other set is positioned to accept another can.

12. A can crusher according to claim 11 including:

(a) a housing having upper and lower compartments with a shelf separating said compartments, said shelf having an opening therein;

(b) said can crusher and said means for rotating said rollers being mounted on said shelf with said can crusher being disposed over said openings;

(c) a can inserting opening in said housing leading to said upper compartment, and a generally vertically disposed tubular member leading from said can inserting opening to said can crusher, said tubular member having a cross-sectional dimension shorter than the length of a can thereby directing the cans into a first end of said crusher in an upright position; and (d) a removable container in said lower compartment for collecting the crushed cans.

* * * * *